US008993947B2

(12) United States Patent
Cole

(10) Patent No.: US 8,993,947 B2
(45) Date of Patent: Mar. 31, 2015

(54) MICROWAVE ENERGY INTERACTIVE INSULATING SHEET AND SYSTEM

(75) Inventor: Lorin R. Cole, Larsen, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 994 days.

(21) Appl. No.: 12/535,949

(22) Filed: Aug. 5, 2009

(65) Prior Publication Data

US 2010/0012652 A1 Jan. 21, 2010

Related U.S. Application Data

(63) Continuation of application No. PCT/US2008/053391, filed on Feb. 8, 2008.

(60) Provisional application No. 60/900,227, filed on Feb. 8, 2007.

(51) Int. Cl.
*H05B 6/80* (2006.01)
*H05B 6/64* (2006.01)
(Continued)

(52) U.S. Cl.
CPC ..... *B65D 81/3446* (2013.01); *B65D 81/264* (2013.01); *B65D 2205/00* (2013.01); *B65D 2581/3466* (2013.01); *B65D 2581/3472* (2013.01); *B65D 2581/3489* (2013.01); *B65D 2581/3494* (2013.01); *H05B 6/6494* (2013.01)
USPC ..... 219/759; 219/730

(58) Field of Classification Search
CPC ..... B65D 81/264; B65D 81/3446; B65D 2205/00; B65D 2581/3472; B65D 2581/3489; B65D 2581/3494; B65D 2581/3466; H05B 6/6494
USPC ..... 219/621, 725–735, 759, 762; 126/107, 126/109, 118, 234, 241, 243; 426/107, 109, 426/118, 234, 241, 243
See application file for complete search history.

(56) References Cited

U.S. PATENT DOCUMENTS 3,662,139 A 5/1972 Love
4,398,994 A 8/1983 Beckett
4,552,614 A 11/1985 Beckett
(Continued)

FOREIGN PATENT DOCUMENTS

EP 0 271 268 A2 6/1988
EP 0 350 660 A2 1/1990
(Continued)

OTHER PUBLICATIONS

International Search Report—PCT/US2008/053391.
(Continued)

*Primary Examiner* — Jianying Atkisson
(74) *Attorney, Agent, or Firm* — Womble Carlyle Sandridge & Rice, LLP

(57) ABSTRACT

A microwave energy interactive insulating structure comprises a layer of microwave energy interactive material supported on a first polymer film layer, a moisture-containing layer joined to the layer of microwave energy interactive material, a second polymer film layer joined to the moisture-containing layer in a predetermined pattern to define a plurality of closed cells between the moisture-containing layer and the second polymer film layer, and an aperture extending through the first polymer film layer, the moisture-containing layer, and the second polymer film layer.

25 Claims, 5 Drawing Sheets

(51) Int. Cl.
*B65D 81/34* (2006.01)
*B65D 81/26* (2006.01)

(56) References Cited

U.S. PATENT DOCUMENTS

| | | | | |
|---|---|---|---|---|
| 4,775,771 | A | 10/1988 | Pawlowski | |
| 4,865,921 | A | 9/1989 | Hollenberg | |
| 4,883,936 | A | 11/1989 | Maynard et al. | |
| 4,890,439 | A | 1/1990 | Smart | |
| 4,896,009 | A | 1/1990 | Pawlowski | |
| 4,927,991 | A | 5/1990 | Wendt et al. | |
| 4,935,276 | A | 6/1990 | Pawlowski et al. | |
| 4,936,935 | A | 6/1990 | Beckett | |
| 4,948,932 | A | 8/1990 | Clough | |
| 4,954,356 | A | 9/1990 | Kappes | |
| 4,963,424 | A | 10/1990 | Beckett | |
| 5,038,009 | A | 8/1991 | Babbitt | |
| 5,039,364 | A | 8/1991 | Beckett et al. | |
| 5,041,325 | A | 8/1991 | Larson | |
| 5,079,397 | A | 1/1992 | Keefer | |
| 5,093,176 | A | 3/1992 | Pribonic et al. | |
| 5,093,364 | A | 3/1992 | Richards | |
| 5,117,078 | A | 5/1992 | Beckett | |
| 5,124,519 | A | 6/1992 | Roy | |
| 5,177,332 | A | 1/1993 | Fong | |
| 5,213,902 | A | 5/1993 | Beckett | |
| 5,220,143 | A | 6/1993 | Kemske et al. | |
| 5,221,419 | A | 6/1993 | Beckett | |
| 5,239,153 | A | 8/1993 | Beckett | |
| 5,254,821 | A | 10/1993 | Walters | |
| 5,260,537 | A | 11/1993 | Beckett | |
| 5,266,386 | A | 11/1993 | Beckett | |
| 5,278,378 | A | 1/1994 | Beckett | |
| 5,298,708 | A * | 3/1994 | Babu et al. | 219/728 |
| RE34,683 | E | 8/1994 | Maynard | |
| 5,340,436 | A | 8/1994 | Beckett | |
| 5,352,465 | A | 10/1994 | Gondek et al. | |
| 5,354,973 | A | 10/1994 | Beckett | |
| 5,391,864 | A | 2/1995 | Bodor et al. | |
| 5,405,663 | A | 4/1995 | Archibald et al. | |
| 5,410,135 | A | 4/1995 | Pollart | |
| 5,466,917 | A | 11/1995 | Matsuki et al. | |
| 5,519,195 | A | 5/1996 | Keefer | |
| 5,530,231 | A | 6/1996 | Walters et al. | |
| 5,585,027 | A | 12/1996 | Young | |
| 5,628,921 | A | 5/1997 | Beckett | |
| 5,672,407 | A | 9/1997 | Beckett | |
| 5,759,422 | A | 6/1998 | Schmelzer | |
| 5,800,724 | A | 9/1998 | Habeger | |
| 6,114,679 | A | 9/2000 | Lai | |
| 6,133,560 | A | 10/2000 | Zeng et al. | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,717,121 | B2 | 4/2004 | Zeng | |
| 6,765,182 | B2 | 7/2004 | Cole | |
| 7,019,271 | B2 | 3/2006 | Wnek et al. | |
| 7,022,959 | B2 | 4/2006 | Cole et al. | |
| 7,351,942 | B2 | 4/2008 | Wnek et al. | |
| 7,365,292 | B2 | 4/2008 | Cole et al. | |
| 7,541,562 | B2 | 6/2009 | Cole et al. | |
| 2002/0160085 | A1 | 10/2002 | Tokita et al. | |
| 2003/0087051 | A1 | 5/2003 | Murray | |
| 2003/0144121 | A1 | 7/2003 | Walsh | |
| 2004/0023000 | A1 | 2/2004 | Young et al. | |
| 2005/0230384 | A1 | 10/2005 | Robison et al. | |
| 2006/0049190 | A1 | 3/2006 | Middleton | |
| 2006/0113300 | A1 | 6/2006 | Wnek et al. | |
| 2006/0138128 | A1 | 6/2006 | Cole et al. | |
| 2006/0151490 | A1 * | 7/2006 | Dodge et al. | 219/732 |
| 2006/0289521 | A1 | 12/2006 | Bohme et al. | |
| 2006/0289522 | A1 * | 12/2006 | Middleton et al. | 219/730 |
| 2007/0221666 | A1 | 9/2007 | Keefe et al. | |
| 2007/0251943 | A1 | 11/2007 | Wnek et al. | |
| 2008/0078759 | A1 | 4/2008 | Wnek et al. | |
| 2008/0081095 | A1 | 4/2008 | Cole et al. | |
| 2008/0087664 | A1 | 4/2008 | Robison et al. | |
| 2008/0230537 | A1 | 9/2008 | Lafferty | |
| 2010/0120313 | A1 | 5/2010 | Bohme et al. | |

FOREIGN PATENT DOCUMENTS

| | | | |
|---|---|---|---|
| EP | 0 350 847 | A2 | 1/1990 |
| EP | 1 132 317 | A1 | 9/2001 |
| JP | S63-086075 | | 4/1988 |
| JP | 1963-185005 | | 11/1988 |
| JP | 2-1980 | | 1/1990 |
| JP | 2-45517 | | 4/1990 |
| JP | 2-503133 | | 9/1990 |
| JP | 03-078769 | | 8/1991 |
| JP | 04-040933 | | 4/1992 |
| JP | 2004-109141 | | 9/1992 |
| JP | 07-153566 | | 6/1995 |
| JP | H10-117941 | | 5/1998 |
| JP | 10-175680 | | 6/1998 |
| JP | 2001-248075 | | 9/2001 |
| JP | 2001-292689 | | 10/2001 |
| JP | 2001-348075 | | 12/2001 |
| JP | 2002-186470 | | 7/2002 |
| JP | 2002-240179 | | 8/2002 |
| WO | WO-89/04585 | A2 | 5/1989 |
| WO | WO-93/09945 | A2 | 5/1993 |
| WO | WO-98/08752 | A2 | 3/1998 |
| WO | WO-98/35887 | A2 | 8/1998 |
| WO | WO 03/066435 | A2 | 8/2003 |
| WO | 2006113403 | A2 | 10/2006 |
| WO | 2006128156 | A2 | 11/2006 |

OTHER PUBLICATIONS

Written Opinion—PCT/US2008/053391.
Supplementary European Search Report for EP 08 72 9363 dated Apr. 5, 2012.
International Serach Report and Written Opinion—PCT/US2005/030231, Feb. 2006, Graphic Packaging International, Inc.
Notice of Reasons for Rejection, JP App. No. 11-073525, Jul. 10, 2007 (with translation).
Notice of Reasons for Rejection, JP App. No. 11-073525, Jan. 15, 2008 (with translation).
Notice of Reasons for Rejection, JP App. No. 2007-292747, Dec. 14, 2010 (with translation).
Notice of Reasons for Rejection, JP App. No. 2007-292747, Sep. 6, 2011 (with translation).
Notice of Reasons for Rejection, JP App. No. 2007-530119, Feb. 17, 2009 (with translation).
Notice of Reasons for Rejection, JP App. No. 2009-193050, Oct. 31, 2011 (with translation).
JP Pat. App. No. 2009-549250, Notice of Reasons for Rejection, Nov. 20, 2012 (translated in part).
JP Pat. App. No. 2009-549250, Notification of Reason for Refusal, dispatched Aug. 29, 2013.
EP Pat. App. No. 08 729 363.5-1708, Communication Pursuant to Article 94(3) EPC, dated Jan. 9, 2014.

* cited by examiner

MICROWAVE ENERGY INTERACTIVE INSULATING SHEET AND SYSTEM

CROSS-REFERENCE TO RELATED APPLICATIONS

This application is a continuation of International Application No. PCT/US2008/053391, filed Feb. 8, 2008, which claims the benefit of U.S. Provisional Application No. 60/900,227, filed Feb. 8, 2007, both of which are incorporated by reference herein in their entirety.

TECHNICAL FIELD

The present invention relates to various materials, packages, constructs, and systems for heating or cooking a microwavable food item. In particular, the invention relates to various materials, packages, constructs, and systems for heating or cooking a food item having a dough or crust in a microwave oven.

BACKGROUND

Microwave ovens provide a convenient means for heating a variety of food items, including dough-based products such as pizzas and pies. However, microwave ovens tend to cook such items unevenly and are unable to achieve the desired balance of thorough heating and a browned, crisp crust. As such, there is a continuing need for improved materials and packages that provide the desired degree of heating, browning, and crisping of dough-based food items in a microwave oven.

SUMMARY

The present invention relates generally to various microwave energy interactive structures or materials that may be used to form sleeves, disks, trays, cartons, packages, and other constructs (collectively "constructs") for improving the heating, browning, and/or crisping of a food item in a microwave oven. The various structures of the invention generally comprise a plurality of components or layers assembled and/or joined to one another in a facing, substantially contacting, layered configuration. Upon sufficient exposure to microwave energy, the structure transforms from a substantially flattened, planar structure to a multi-dimensional, thermal insulating structure. The structure may provide thermal insulation between a food item and its environment and may include one or more features that improve the heating, browning, and/or crisping of the food item. Such a structure may be referred to herein as a "microwave energy interactive insulating structure", "microwave energy interactive insulating material", "insulating material", or "insulating structure". The insulating structure may be cut or formed into various shaped sheets and/or may be integrated into various cartons or other packages. If desired, the structure may be cut into a sheet that may be used with a tray or platform for elevating the food item during heating.

The structures generally include at least one microwave energy interactive element, for example, a susceptor that converts at least a portion of impinging microwave energy into thermal energy. At least one aperture extends through the microwave energy interactive element and, optionally, through one or more of the various other layers of the structure.

In one aspect, the invention is directed to a microwave energy interactive insulating structure comprising a layer of microwave energy interactive material supported on a first polymer film layer, a moisture-containing layer joined to the layer of microwave energy interactive material, and a second polymer film layer joined to the moisture-containing layer such that the moisture-containing layer is positioned between the microwave energy interactive material and the second polymer film layer. The moisture-containing layer is joined to the second polymer film layer in a predetermined pattern that defines a plurality of closed cells. At least some of the closed cells may expand or inflate in response to microwave energy.

The microwave energy interactive material circumscribes at least one aperture that generally increases the heat generated in an area immediately adjacent to the aperture. The structure may include a plurality of apertures arranged in numerous ways.

In another aspect, the invention encompasses a microwave energy interactive insulating structure comprising a susceptor film in a superposed, facing relationship with a thermal insulating layer, where the thermal insulating layer includes a plurality of substantially closed, substantially vapor impermeable insulating cells. One or more apertures extend through the susceptor film and the thermal insulating layer.

In still another aspect, the invention contemplates a system for heating a food item in a microwave oven. The system includes a platform for receiving a food item and a microwave energy interactive insulating structure overlying the platform. The microwave energy interactive insulating structure may include a layer of microwave energy interactive material that converts at least a portion of impinging microwave energy into thermal energy, a plurality of closed cells that are capable of reducing heat transfer from the layer of microwave energy interactive material, and a plurality of apertures extending through the layer of microwave energy interactive material and at least some of the closed cells. The relative area of apertures and closed cells within the microwave energy interactive insulating structure may be selected to provide the desired degree of heating, browning, crisping, and/or venting of a food item seated on the microwave energy interactive insulating structure. If desired, the platform may include a plurality of apertures in an aligned relationship with the apertures extending through the microwave energy interactive insulating structure.

Other aspects, features, and advantages of the present invention will become apparent from the following description and accompanying figures.

BRIEF DESCRIPTION OF THE DRAWINGS

The description refers to the accompanying drawings, some of which are schematic, in which like reference characters refer to like parts throughout the several views, and in which.

DESCRIPTION

The present invention relates generally to various microwave energy interactive insulating structures that may be used to form microwave heating packages or other constructs that improve the heating, browning, and/or crisping of a food item in a microwave oven. The various structures of the invention generally comprise a plurality of components or layers assembled and/or joined to one another in a facing, substantially contacting, layered configuration. Each of the various insulating structures includes at least one microwave energy interactive element and at least one aperture extending through the microwave energy interactive element. The microwave energy interactive element is selected to attain the desired degree of heating, browning, and/or crisping of the food item. While not wishing to be bound by theory, it is believed that the apertures cause the formation of localized electric fields that increase the temperature of the microwave energy interactive element within the sheet adjacent to each aperture. As a result, the heating, browning, and/or crisping of an adjacent food item may be enhanced in the areas adjacent and/or proximate to the apertures. Additionally, the apertures may permit the venting of moisture generated during heating, thereby further enhancing browning and/or crisping of the food item.

Typically, the microwave energy interactive element comprises a thin layer of microwave energy interactive material (i.e., a "susceptor") (generally less than about 100 angstroms in thickness, for example, from about 60 to about 100 angstroms in thickness) that tends to absorb at least a portion of impinging microwave energy and convert it to thermal energy (i.e., heat) at the interface with a food item. Susceptor elements often are used to promote browning and/or crisping of the surface of a food item. The susceptor may be supported on a microwave energy transparent substrate, for example, a layer of paper or polymer film for ease of handling and/or to prevent contact between the microwave energy interactive material and the food item. Further, in accordance with one aspect of the invention, the susceptor may be combined with a plurality of expanded or expandable cells to form a microwave energy interactive insulating structure or material. The expanded or expandable cells are generally capable of providing some degree of thermal insulation to an adjacent food item.

Figure 1A:
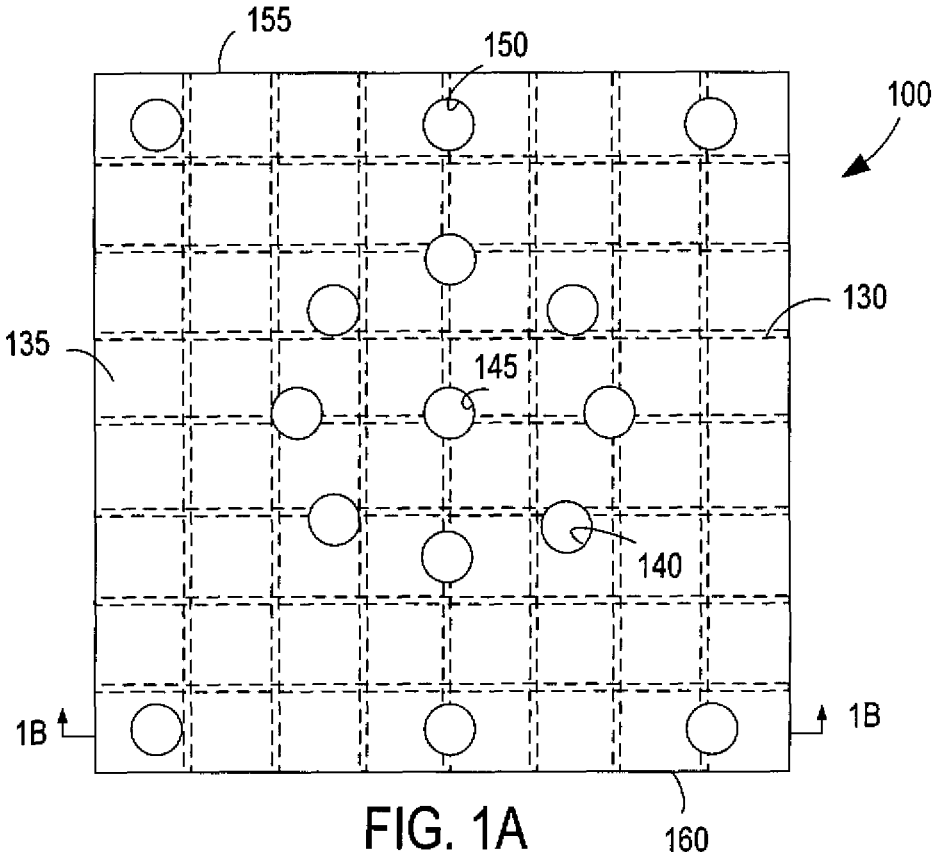
FIG. 1A is a schematic top plan view of an exemplary microwave energy interactive insulating sheet including a plurality of apertures according to various aspects of the invention.
Figure 1B:
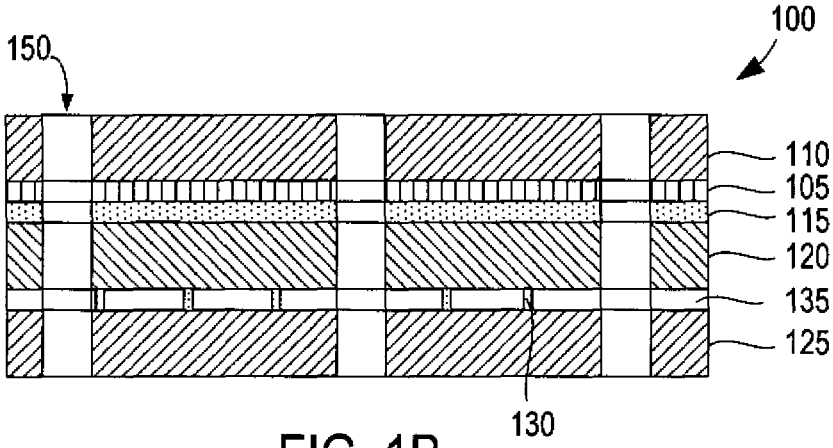
FIG. 1B is a schematic cross-sectional view of the sheet of FIG. 1A, taken along a line 1B-1B.

For example, FIGS. 1A and 1B respectively illustrate a schematic top plan view and schematic cross-sectional view of an exemplary microwave energy interactive insulating sheet 100 in accordance with the invention. In this example, the insulating sheet 100 is somewhat square in shape. However, in this and other examples illustrated herein or contemplated hereby, the various insulating sheets may have any other suitable shape, for example, circular, triangular, rectangular, trapezoidal, or any other regular or irregular shape.

The insulating sheet 100 includes a susceptor film, which comprises a thin layer of microwave energy interactive material 105 supported on a first polymer film 110, for example, polyethylene terephthalate, bonded by lamination with an adhesive 115 (or otherwise bonded) to a dimensionally stable substrate 120, for example, paper. The substrate 120 is bonded to a second polymer film 125, for example, biaxially-oriented polyethylene terephthalate, using a patterned adhesive 130 (or otherwise) to form a plurality of substantially vapor impermeable closed cells 135 in the material 100.

As shown in FIG. 1A, the sheet includes a plurality of apertures 140 arranged in a ring-like configuration around a substantially centrally located aperture 145. Additionally, two sets of three apertures 150 lie proximate to a pair of opposed edges 155, 160 of the sheet 100. At least some of the apertures extend though the entire thickness of the sheet 100, as shown, for example, in FIG. 1B with apertures 150. Any of the apertures 140, 145, 150 may extend through the lines of adhesion 130, the insulating cells 135, or any combination thereof.

In this example, apertures 140, 145, 150 are substantially circular in shape and substantially equal in size. In one example, apertures 140, 145, 150 have a diameter of about 0.25 in. The cells may be about 1 in. in length and width between lines of adhesion. In another example, apertures 140, 145, 150 have a diameter of about 0.5 in. In other examples, apertures 150 may be omitted. However, numerous other sizes and configurations of apertures are contemplated.

Figure 1C:
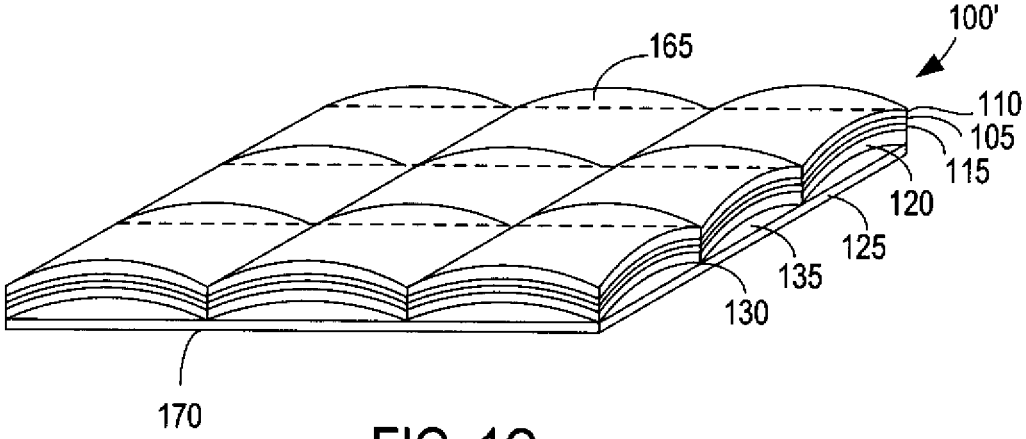
FIG. 1C schematically depicts the insulating sheet of FIGS. 1A and 1B upon exposure to microwave energy.

Upon sufficient exposure to microwave energy, the closed cells expand or inflate thereby causing the microwave energy interactive material to bulge and deform away from the remainder of the insulating structure, typically toward the surface of the food item. More particularly, as shown in FIG. 1C (which shows a portion of the sheet 100 without apertures), as the microwave interactive material 105 heats, water vapor and other gases released from the substrate 120, for example, paper, and any air trapped in the thin space between the second polymer film 125 and the substrate 120 in the closed cells 135, expand. The expansion of water vapor and air in the closed cells 135 applies pressure on the susceptor film 110 and the substrate 120 on one side and the second polymer film 125 on the other side of the closed cells 135. Each side of the material 100 forming the closed cells 135 reacts simultaneously, but uniquely, to the heating and vapor expansion. The cells 135 expand or inflate to form a quilted top surface 165 and bottom surface 170. This expansion may occur within 1 to 15 seconds in an energized microwave oven, and in some instances, may occur within 2 to 10 seconds. The resulting insulating material 100' has a pillowed appearance. When microwave heating ceases, the cells 135 typically deflate and return to a somewhat flattened state.

Such structures may enhance the heating, browning, and crisping of the food item in a microwave oven in numerous ways. First, the water vapor, air, and other gases contained in the closed cells provide insulation between the food item and the ambient environment of the microwave oven, thereby increasing the amount of sensible heat that stays within or is transferred to the food item. Additionally, the lofting of the structure causes the structure to conform more closely to the surface of the food item, thereby placing the microwave energy interactive material into closer proximity with the food item and enhancing browning and/or crisping. Furthermore, insulating materials may help to retain moisture in the food item when cooking in the microwave oven, thereby improving the texture and flavor of the food item. Additional benefits and aspects of such materials are described in PCT Application No. PCT/US03/03779, U.S. Pat. No. 7,019,271, and U.S. Patent Application Publication No. US 2006-0113300 A1, published Jun. 1, 2006, each of which is incorporated by reference herein in its entirety. One example of a microwave energy interactive insulating material that may be used to form an apertured insulating material according to the invention is QUJILTWAVE® packaging material, commercially available from Graphic Packaging International, Inc. (Marietta, Ga.).

It has been discovered that a microwave energy interactive insulating structure including at least one aperture significantly enhances the heating, browning, and/or crisping of a food item as compared with a similar structure without the aperture. This result is unexpected, at least in theory, because the presence of apertures would seem to diminish the ability of one or more expandable cells to inflate, which in turn would seem diminish the ability of the structure to urge the susceptor towards the surface of the food item. However, while not wishing to be bound by theory, it is believed that the apertures create localized electric fields that enhance the heating, browning, and/or crisping of the adjacent food item. Additionally, it is believed that the presence of the apertures permits moisture generated during the heating cycle to be directed away from the food item. As a result, the browning and/or crisping of the food item may be improved further. Thus, on balance, the enhanced performance provided by the apertures generally exceeds the loss in insulating performance of the structure.

FIGS. 2-7 schematically depict several exemplary variations of the microwave energy interactive insulating structure 100 of FIG. 1, each of which includes at least one aperture in accordance with the invention. It will be understood that while various exemplary embodiments are shown and described in detail herein, any of the features may be used in any combination, and that such combinations are contemplated hereby. Additionally, for purposes of simplicity, and not limitation, structures with more than one aperture are illustrated herein. However, it will be understood that structures with only one aperture are contemplated by the invention.

Figure 2:
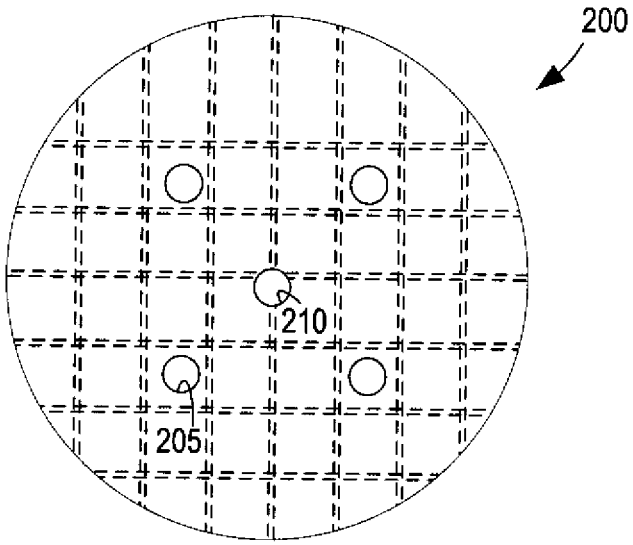
FIGS. 2-5 depict schematic top plan views of other exemplary heating sheets according to various aspects of the invention.

Turning to FIG. 2, the exemplary insulating sheet 200 has a substantially circular shape and includes a plurality of apertures 205 arranged in a somewhat square configuration around a substantially centrally located aperture 210, such that the apertures 205, 210 collectively resemble an "X". In one specific example, apertures 205, 210 may have a diameter of about 0.5 in.

Figure 3:
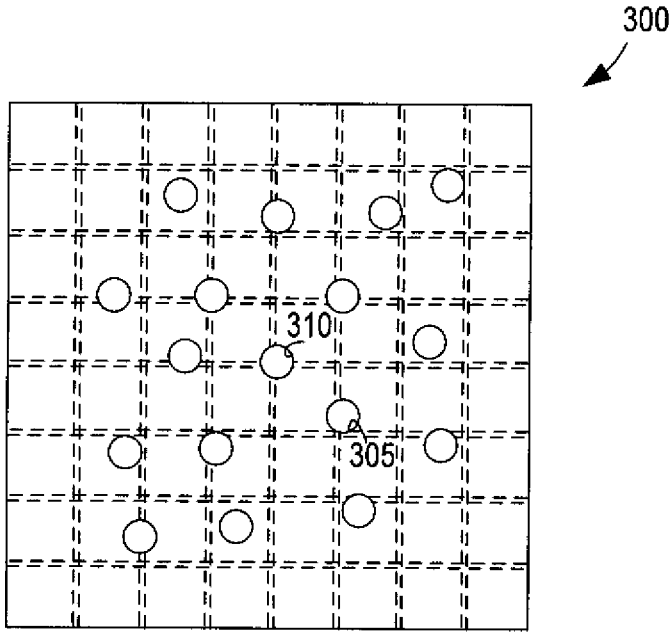

In FIG. 3, the exemplary microwave energy interactive insulating sheet 300 includes a plurality of apertures 305 arranged in a somewhat random configuration around a substantially centrally located aperture 310. In this example, apertures 305, 310 are substantially circular in shape and substantially equal in size. However, numerous other shapes, sizes, and arrangements of apertures are contemplated. In one particular example, apertures 305, 310 may have a diameter of about 0.25 in.

Figure 4:
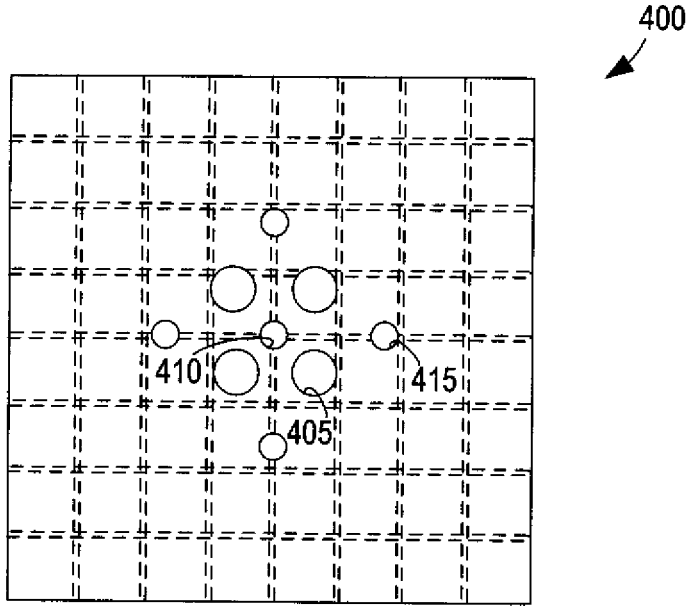

In FIG. 4, the microwave energy interactive insulating sheet 400 includes a plurality of apertures 405 arranged in a somewhat square configuration around a substantially centrally located aperture 410, such that the apertures 405, 410 collectively form the shape of an "X". The insulating sheet 400 also includes a plurality of apertures 415 arranged in a somewhat square or diamond configuration around apertures 405, with apertures 415 being in an offset, staggered configuration relative to apertures 405. In this example, each of apertures 415 is substantially centered between each pair of adjacent apertures 405. In each of various examples, apertures 405 may have a diameter of about 0.375 in., aperture 410 may have a diameter of about 0.25 in., and/or apertures 415 may have a diameter of about 0.25 in. However, other sizes and configurations are encompassed by this invention.

Figure 5:
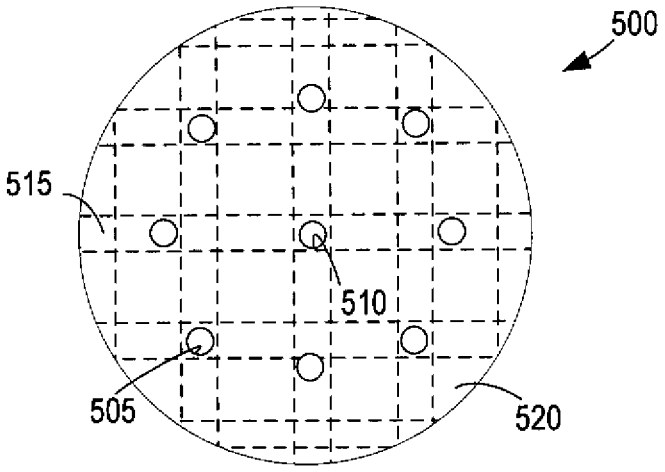

Turning to FIG. 5, the apertures 505, 510 are circumscribed by respective portions of the lines of adhesion 515, which are wider than lines of adhesion 130 in insulating sheet 100 of FIG. 1, such that none of the apertures 505, 510 penetrate (or render uninflatable) any of the insulating cells 520. The apertures may have any suitable dimensions, and in one particular example, each of apertures 505, 510 may have a diameter of about 0.25 in., 0.5 in., or any other suitable diameter.

For each of the various examples illustrated herein and numerous others contemplated hereby, the microwave energy insulating sheet may be used in cooperation with a tray or platform on which a food item may be seated to distance the food item from the floor of the microwave oven further. In this manner, the food item may be able to retain more heat generated by the microwave energy interactive material in the insulating sheet. The insulating sheet may be affixed to the platform partially, substantially, or entirely, or may be separate from the platform. If desired, the tray may include one or more apertures that may or may not correspond to the size, shape, number, and configuration of the apertures in the insulating sheet. In this manner, any ventilation of moisture through apertures in the platform and/or the insulating sheet can be enhanced, thereby improving the browning and/or crisping of the food item.

Figure 6:
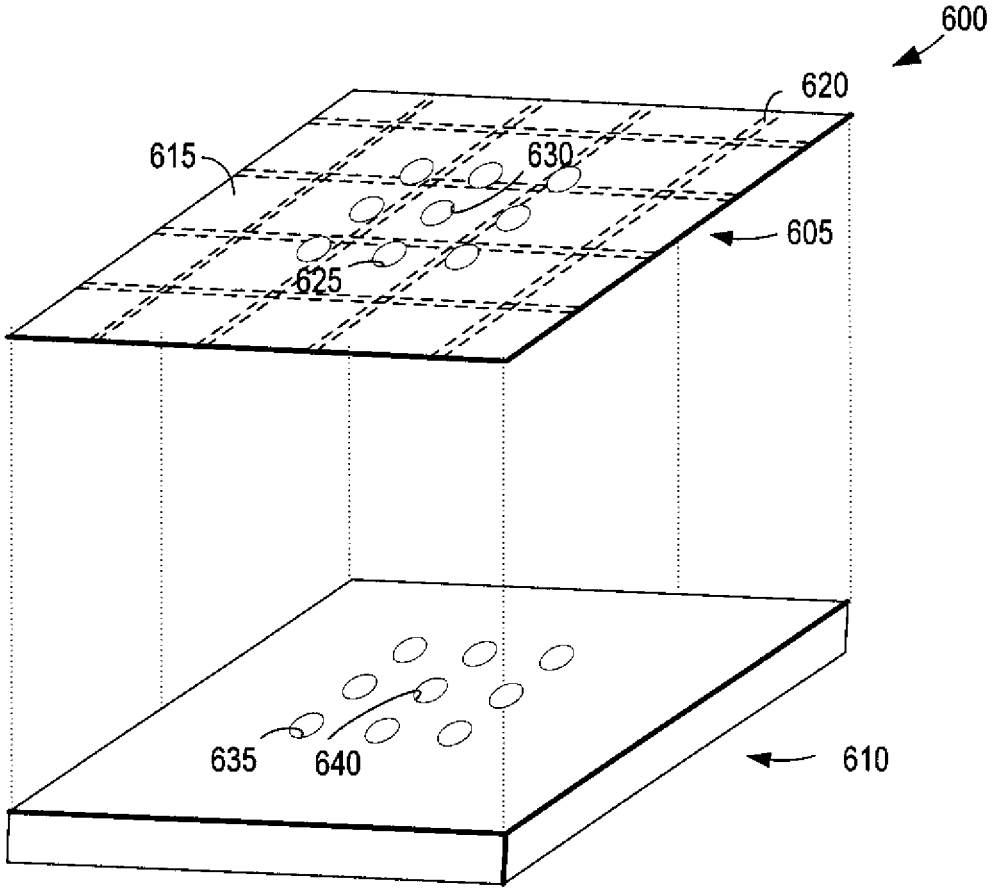
FIG. 6 schematically depicts an exemplary microwave energy interactive heating system including an apertured microwave energy interactive insulating sheet and a tray or platform according to various aspects of the invention.

For example, FIG. 6 illustrates an exploded perspective view of an exemplary microwave energy interactive heating system including a microwave energy interactive insulating sheet 605 and a platform 610. The insulating sheet 605 includes a plurality of expandable insulating cells 615 defined by lines of adhesion 620. A plurality of apertures 625 are arranged in a square-like configuration around a substantially centrally located aperture 630. Likewise, the platform 610 includes a plurality of apertures 635 are arranged in a square-like configuration around a substantially centrally located aperture 640. Apertures 625 may align substantially with apertures 635. Aperture 630 may align substantially with aperture 640.

Figure 7:
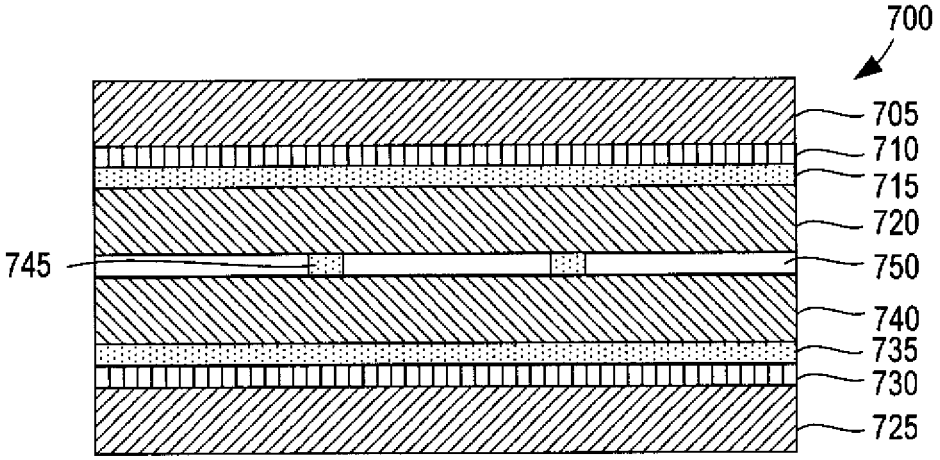
FIGS. 7-9 schematically depict other exemplary microwave energy interactive insulating materials that may be used in accordance with the invention.
Figure 8:
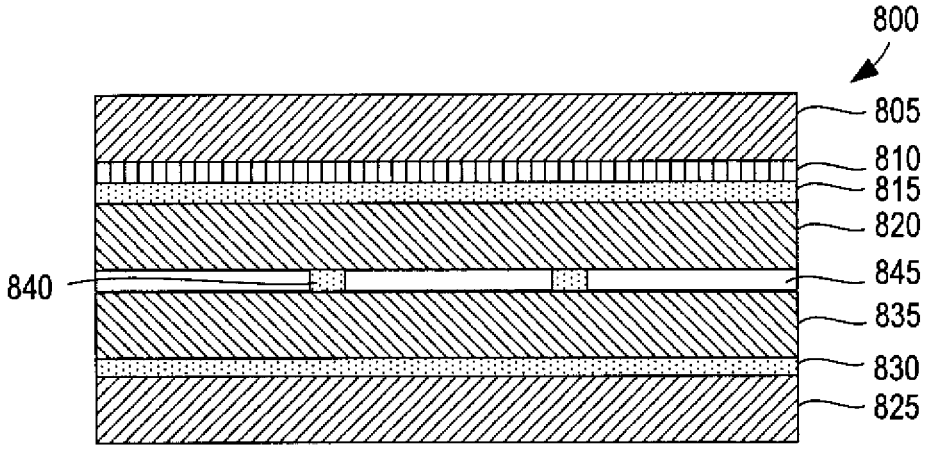
Figure 9:
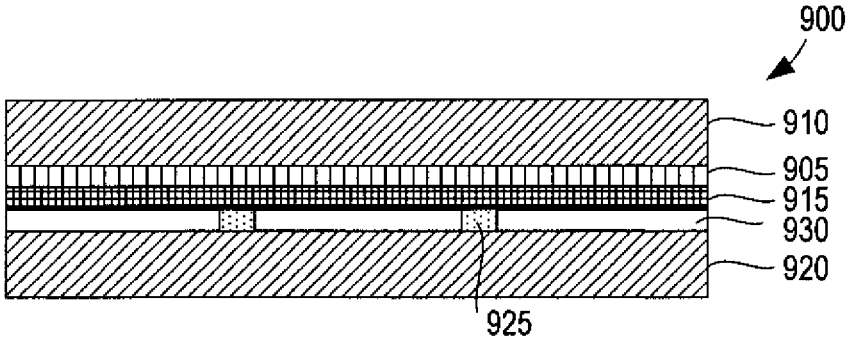

FIGS. 7-9 schematically depict examples of alternate insulating structures that may be provided with apertures in accordance with the invention, for example, using the aperture configurations illustrated in FIGS. 1-6 or any other suitable configuration of apertures. In these and other examples shown herein, it should be understood that the layer thicknesses are not necessarily shown in perspective. In some instances, for example, the adhesive layers may be very thin with respect to other layers, but are nonetheless shown with some thickness for purposes of clearly illustrating the arrangement of layers.

Referring first to FIG. 7, an insulating material 700 is shown with two symmetrical layer arrangements adhered together by a patterned adhesive layer. The first symmetrical layer arrangement, beginning at the top of the drawings, comprises a polymer film layer 705, a layer of microwave energy interactive material 710, an adhesive layer 715, and a paper or paperboard layer 720. The microwave energy interactive material 710 may comprise a metal, such as aluminum, deposited on at least a portion of the polymer film layer 705. The polymer film 705 and microwave energy interactive material 710 together define a susceptor. The adhesive layer 715 bonds the polymer film 705 and the microwave energy interactive material layer 710 to the paperboard layer 720.

The second symmetrical layer arrangement, beginning at the bottom of the drawing, also comprises a polymer film layer 725, a microwave energy interactive material layer 730, an adhesive layer 735, and a paper or paperboard layer 740. If desired, the two symmetrical arrangements may be formed by folding one layer arrangement onto itself. The layers of the second symmetrical layer arrangement are bonded together in a similar manner as the layers of the first symmetrical arrangement. A patterned adhesive layer 745 is provided between the two paper layers 720, 740, and defines a pattern of closed cells 750 configured to expand when exposed to microwave energy. An insulating material 700 having two microwave energy interactive material layers 710, 730 typically generates more heat and greater cell loft. As a result, such a material may be able to elevate a food item seated thereon to a greater extent than an insulating material having a single microwave energy interactive material layer.

Referring to FIG. 8, yet another insulating material 800 is shown. The material 800 includes a polymer film layer 805, a microwave energy interactive material layer 810, an adhesive layer 815, and a paper layer 820. Additionally, the material 800 may include a polymer film layer 825, an adhesive 830, and a paper layer 835. The layers are adhered or affixed by a patterned adhesive 840 defining a plurality of closed expandable cells 845.

Turning now to FIG. 9, still another exemplary insulating material 900 is depicted. In this example, one or more reagents are used to generate a gas that expands the cells of the insulating material. For example, the reagents may comprise sodium bicarbonate ($NaHCO_3$) and a suitable acid. When exposed to heat, the reagents react to produce carbon dioxide. As another example, the reagent may comprise a blowing agent. Examples of blowing agents that may be suitable include, but are not limited to, p-p'-oxybis(benzenesulphonylhydrazide), azodicarbonamide, and p-toluenesulfonylsemicarbazide. However, it will be understood that numerous other reagents and released gases are contemplated hereby. Such structures are described in further detail in U.S. Patent Application Publication No. 2006/0289521A1, published on Dec. 28, 2006, which is incorporated by reference herein in its entirety.

In the example shown in FIG. 9, a thin layer of microwave interactive material 905 is supported on a first polymer film 910 to form a susceptor film. One or more reagents 915, optionally within a coating, overlie at least a portion of the layer of microwave interactive material 905. The reagent 915 is joined to a second polymer film 920 using a patterned adhesive 925 or other material, or using thermal bonding, ultrasonic bonding, or any other suitable technique, such that closed cells 930 (shown as a void) are formed in the material 900. After sufficient exposure to microwave energy, water vapor or other gases are released from or generated by the reagent 915. The resulting gas applies pressure on the susceptor film 910 on one side and the second polymer film 920 on the other side of the closed cells 930. Each side of the material 900 forming the closed cells 930 reacts simultaneously, but uniquely, to the heating and vapor expansion to form a quilted insulating material, similar in appearance to that shown in FIG. 1C. This expansion may occur within 1 to 15 seconds in an energized microwave oven, and in some instances, may occur within 2 to 10 seconds. Even without a paper or paperboard layer, the water vapor or other gas resulting from the reagent is sufficient both to inflate the expandable cells and to absorb any excess heat from the microwave energy interactive material.

In yet another example (not shown), the insulating structure may comprise a layer of microwave energy interactive material supported on a polymer film layer (or other substrate) at least partially joined to a closed cell foam, air cellular material (e.g., bubble material, for example, BUBBLE WRAP®, commercially available from Sealed Air Corporation), or any other insulating material. The insulating structure may be configured so the layer of microwave energy interactive material is disposed between the polymer film and the insulating material.

Numerous other variations are contemplated by the invention. For example, the number, shape, size, and placement of the apertures may vary for each application, depending on type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

The apertures may be arranged in any configuration, tiled or staggered, random or patterned, evenly spaced across the structure, concentrated in one or more areas, or in any other suitable manner. One or more of the apertures may be circular, oval, triangular, square, hexagonal, or any other regular or irregular shape.

The apertures may have various dimensions, for example, a major linear dimension of from about 0.1 to about 1 in. More particularly, in each of various examples, the apertures may have a major linear dimension of from about 0.2 to about 0.9 in., from about 0.3 to about 0.8 in., from about 0.4 to about 0.7 in., from about 0.5 to about 0.6 in., from about 0.25 in. to about 0.75 in., from about 0.375 in. to about 0.675 in., about 0.1 in., about 0.15 in., about 0.2 in., about 0.25 in., about 0.3 in., about 0.35 in., about 0.4 in., about 0.45 in., about 0.5 in., about 0.55 in., about 0.6 in., about 0.65 in., about 0.7 in., about 0.75 in., about 0.8 in., about 0.85 in., about 0.9 in., about 0.95 in., or any other suitable size.

Each aperture may be spaced any suitable distance from an adjacent aperture. For example, each aperture may be spaced a distance of from about 0.25 in. to about 1.5 in. from an adjacent aperture. In each of more particular examples, each aperture may be spaced a distance of from about 0.3 to about 1.4 in., from about 0.4 to about 1.3 in., from about 0.5 to about 1.2 in., from about 0.6 to about 1.1 in., from about 0.7 to about 1 in., from about 0.75 in. to about 1 in., from about 0.8 to about 0.9 in., about 0.25 in., about 0.3 in., about 0.35 in., about 0.4 in., about 0.45 in., about 0.5 in., about 0.55 in., about 0.6 in., about 0.65 in., about 0.7 in., about 0.75 in., about 0.8 in., about 0.85 in., about 0.9 in., about 0.95 in., about 1 in., about 1.05 in., about 1.1 in., about 1.15 in., about 1.2 in., about 1.25 in., or about 1.3 in. from an adjacent aperture.

Likewise, the closed cells (or "expandable cells" or "insulating cells" or "expandable insulating cells") may have any suitable size, shape, and configuration. In each of various examples, each closed cell independently may have a major linear dimension of from about 0.25 to about 3 in., for example, from about 0.25 to about 0.5 in., from about 0.5 to about 0.75 in., from about 0.75 to about 1 in., from about 1 to about 1.25 in., from about 1.25 to about 1.5 in., from about 1.5 to about 1.75 in., from about 1.75 to about 2 in., from about 2 to about 2.25 in., from about 2.25 to about 2.5 in., from about 2.5 to about 2.75 in., from about 2.75 to about 3 in., from about 0.5 to about 1.5 in., or any other suitable dimensions.

The expandable insulating cells may be formed in numerous ways, for example, using an adhesive, chemical or thermal bonding, or other fastening agent or process, to form one or more closed cells between the moisture-containing layer (e.g. paper or paperboard) and the second polymer film layer. For purposes of simplicity, and not limitation, the predetermined pattern of adhesion, bonding, or fastening may be referred to herein as "lines of adhesion" or a "pattern of adhesion" or a "patterned adhesive" or an "adhesive pattern". However, it will be understood that there are numerous methods of forming the closed cells, and that such methods are contemplated hereby.

If desired, the pattern of adhesion may be selected to enhance cooking of a particular food item. For example, where the food item is a larger item, the adhesive pattern may be selected to form substantially uniformly shaped expandable cells. Where the food item is a small item or has smaller contours, the adhesive pattern may be selected to form a plurality of different sized cells to allow the individual items or surfaces to be variably contacted. While several examples are provided herein, it will be understood that numerous other patterns are contemplated hereby, and the pattern selected will depend on the heating, browning, crisping, and insulating needs of the particular food item.

It will be understood that depending on the relative sizes and positions of the apertures and expandable cells, one or more cells may be rendered uninflatable or unexpandable due to the presence of an aperture extending partially or completely through the cell. While the insulating capability of such a cell may be diminished, the areas of the sheet adjacent to the aperture may still provide a heating, browning, and/or crisping effect. Where it is desired to maintain the insulating effect of one or more particular cells, it is contemplated that the affected aperture may be placed within (and circumscribed by) the line of adhesion. Thus, the lines of adhesion may have any shape and width depending on the particular heating application.

Furthermore, the relative size and of each aperture and insulating cell, and/or the relative total area of the apertures and insulating cells may be adjusted to attain the desired balance between localized heating, browning, and/or crisping adjacent to the apertures and generalized heating, browning, and/or crisping in the remaining areas of the structure. In general, the aperture may have a major linear dimension that is less than or equal to the major linear dimension of the insulating cell. More particularly, in each of various examples, the ratio of the major linear dimension of each insulating cell to each aperture independently may be about 1:1, about 2:1, about 3:1, about 4:1, about 5:1, about 6:1, about 7:1, about 8:1, about 9:1, about 10:1, or any other suitable ratio.

The aperture(s) generally may comprise from about 2 to about 50% of the overall area of the layer of the microwave energy interactive material and/or the insulating structure (as measured with the insulating structure lying flat). In each of various examples, the aperture(s) may comprise from about 2 to about 5%, from about 5 to about 10%, from about 10 to about 15%, from about 15 to about 20%, from about 20 to about 25%, from about 25 to about 30%, from about 30 to about 35%, from about 35 to about 40%, from about 40 to about 45%, from about 45 to about 50%, from about 5 to about 20%, from about 10 to about 25%, from about 15 to about 30%, or any other suitable percentage of the overall area of the microwave energy interactive material and/or the insulating structure.

As stated previously, any number and configuration of apertures may be used. Further, while physical apertures are discussed in detail herein, it will be understood that any of the various insulating structures of the invention may include one or more "non-physical apertures" (not shown). A non-physical aperture is a microwave energy transparent area that allows microwave energy to pass through the structure without an actual void or hole cut through the structure. Such areas may be formed by simply not applying a microwave energy interactive material to the particular area, or by removing microwave energy interactive material in the particular area, or by chemically and/or mechanically deactivating the microwave energy interactive material in the particular area. While both physical and non-physical apertures allow the food item to be heated directly by the microwave energy, a physical aperture also provides a venting function to allow steam or other vapors to escape from the interior of the construct.

If desired, multiple layers of insulating sheets may be used to enhance the insulating properties of the insulating material and, therefore, enhance the browning and crisping of the food item. Multiple layers of cells may be particularly advantageous where the food item has a greater weight and, therefore, is more difficult to elevate from the floor of the microwave oven and/or where greater elevation is needed to achieve the desired degree of heating, browning, and/or crisping. The various sheets of similar and/or dissimilar insulating materials may be superposed in any configuration as needed or desired for a particular application. For example, two sheets of an insulating material may be arranged so that their respective susceptor film layers are facing away from each other. As another example, two sheets of an insulating material may be arranged so that their respective susceptor film layers are facing towards each other. In still another example, three or more sheets of an insulating material may be arranged in any manner and superposed. The sheets may remain separate or may be joined using any suitable process or technique, for example, thermal bonding, adhesive bonding, ultrasonic bonding or welding, mechanical fastening, or any combination thereof. If the greatest degree of loft is desirable, it might be beneficial to use a discontinuous, patterned adhesive bond that will not restrict the expansion and flexing of the layers within the material. In contrast, where structural stability is desirable, a continuous adhesive bond might provide the desired result. Numerous examples of such structures are provided in U.S. Patent Application Publication No. US 2007/0251943 A1, published, Nov. 1, 2007.

Any of the various layers of the structures and constructs encompassed by the invention may be formed from various materials, provided that the materials are substantially resistant to softening, scorching, combusting, or degrading at typical microwave oven heating temperatures, for example, at from about 250° F. to about 425° F. The particular materials used may include microwave energy interactive materials, for example, those used to form susceptors and other microwave energy interactive elements, and microwave energy transparent or inactive materials, for example, those used to form the polymer film layers, moisture-containing layer, dimensionally stable support, tray, platform, and so on.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymer or other suitable matrix or binder, and may include flakes of an electroconductive metal, for example, aluminum.

The substrate typically comprises an electrical insulator, for example, a polymer film or other polymeric material. As used herein the terms "polymer", "polymer film", and "polymeric material" include, but are not limited to, homopolymers, copolymers, such as for example, block, graft random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one example, the barrier film has an OTR of less than about 10 $cc/m^2/day$. In another example, the barrier film has an OTR of less than about 1 $cc/m^2/day$. In still another example, the barrier film has an OTR of less than about 0.5 $cc/m^2/day$. In yet another example, the barrier film has an OTR of less than about 0.1 $cc/m^2/day$.

The barrier film may have a water vapor transmission rate (WVTR) of less than about 100 $g/m^2/day$ as measured using ASTM F1249. In one example, the barrier film has a WVTR of less than about 50 $g/m^2/day$. In another example, the barrier film has a WVTR of less than about 15 $g/m^2/day$. In yet another example, the barrier film has a WVTR of less than about 1 $g/m^2/day$. In still another example, the barrier film has a WVTR of less than about 0.1 $g/m^2/day$. In a still further example, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683. Although particular examples of patterns of microwave energy interactive material are shown and described herein, it should be understood that other patterns of microwave energy interactive material are contemplated by the present invention.

The microwave energy interactive insulating structure also may include one or more dimensionally stable, moisture-containing, microwave energy transparent layers. In one aspect, the insulating structure may include a paper or paper-based material generally having a basis weight of from about 15 to about 60 lbs/ream (lb/300 sq. ft), for example, from about 20 to about 40 lbs/ream. In one particular example, the paper has a basis weight of about 25 lbs/ream.

The present invention may be illustrated further by the following examples, which are not intended to be limiting in any manner.

EXAMPLES

Kraft DiGiorno pizzas were heated in a 1000W Sharp microwave oven using various microwave energy interactive sheets and platforms. Each pizza was heated for about 6 minutes, allowed to cool, inverted to examine the bottom of the pizza crust. The results of each evaluation are presented in Table 1, where:

- Excellent: crust uniformly browned and crisped; no burning or over-dehydrating;
- Very good: center portion browned and crisped; outer portion browned but lacking overall uniformity;
- Good: center portion browned and crisped; outer portions browned lightly or not at all;
- Fair: some portions of the crust burned and/or over-dehydrated; and
- Poor: crust substantially burned and/or over-dehydrated.

TABLE 1

| Example | Description | Result |
|---|---|---|
| 1 | Metallized polyethylene terephthalate film (plain susceptor film) (not shown) | Fair |
| 2 | QUILTWAVE ® packaging material, as shown schematically in FIGS. 1B-1C without apertures | Good |
| 3 | QUILTWAVE ® packaging material with 4 apertures forming a square around a central aperture, each about 0.5 in. diameter, as shown schematically in FIG. 2 | Good |
| 4 | QUILTWAVE ® packaging material with 8 apertures encircling a central aperture, each about 0.5 in. diameter, as shown schematically in FIG. 1 but without apertures 150 | Fair |
| 5 | QUILTWAVE ® packaging material with 17 apertures randomly positioned, each about 0.25 in. diameter, as shown schematically in FIG. 3 | Good |
| 6 | QUILTWAVE ® packaging material with 8 apertures encircling a central aperture, each about 0.25 in, diameter, as shown schematically in FIG. 1 but without apertures 150 | Fair |
| 7 | QUILTWAVE ® packaging material with 12 apertures randomly positioned, each about 0.5 in. diameter, as shown schematically in FIG. 3 but with only 12 apertures | Excellent |
| 8 | QUILTWAVE ® packaging material with 8 apertures encircling a central aperture and 3 additional apertures spaced along each of 2 sides, each about 0.5 in. diameter, as shown schematically in FIG. 1 | Excellent |
| 9 | DiGiorno pizza elevated susceptor platform with a central aperture, a first ring of 8 apertures around the central aperture, and a second ring of 8 apertures around the periphery, each being about 0.25 in. diameter (not shown) | Fair |

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be recognized by those skilled in the art, that various elements discussed with reference to the various embodiments may be interchanged to create entirely new embodiments coming within the scope of the present invention. It is intended that all matter contained in the above description or shown in the accompanying drawings shall be interpreted as illustrative only and not limiting. Changes in detail or structure may be made without departing from the spirit of the invention. The detailed description set forth herein is not intended nor is to be construed to limit the present invention or otherwise to exclude any such other embodiments, adaptations, variations, modifications, and equivalent arrangements of the present invention.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A microwave energy interactive insulating structure comprising:

a layer of microwave energy interactive material supported on a first polymer film layer;

a moisture-containing layer joined to the layer of microwave energy interactive material;

a second polymer film layer joined to the moisture-containing layer such that the moisture-containing layer is positioned between the microwave energy interactive material and the second polymer film layer, the second polymer film layer being joined to the moisture-containing layer in a predetermined pattern to define a plurality of first cells between the moisture-containing layer and the second polymer film layer, the plurality of first cells comprising a plurality of second cells being adapted to inflate in response to sufficient exposure to microwave energy, and the predetermined pattern comprising a plurality of lines of adhesion disposed between the moisture-containing layer and the second polymer film layer; and a plurality of physical apertures extending through each of the first polymer film layer, the moisture-containing layer, and the second polymer film layer, the physical apertures being arranged so that the plurality of first cells further comprises a plurality of third cells that are interspersed among the second cells, wherein for each third cell of the plurality of third cells, at least one physical aperture of the plurality of physical apertures extends at least partially through the third cell so that the at least one physical aperture inhibits any inflatability of the third cell, the plurality of third cells comprises a first one of the third cells and a second one of the third cells, the plurality of lines of adhesion comprises a first line of adhesion positioned between the first one of the third cells and the second one of the third cells, and a first physical aperture of the plurality of physical apertures is configured so that the first physical aperture extends at least partially through each of the first line of adhesion, the first one of the third cells, and the second one of the third cells.

2. The microwave energy interactive insulating structure of claim 1, wherein a physical aperture of the plurality of physical apertures has a major linear dimension of about 0.25 inches.

3. The microwave energy interactive insulating structure of claim 1, wherein a physical aperture of the plurality of physical apertures has a major linear dimension of about 0.5 inches.

4. The microwave energy interactive insulating structure of claim 1, wherein at least some of the first cells have a major linear dimension of from about 0.5 to about 1.5 inches.

5. The microwave energy interactive insulating structure of claim 1, wherein the plurality of physical apertures includes a substantially centrally located physical aperture.

6. The microwave energy interactive insulating structure of claim 5, wherein the plurality of physical apertures includes a plurality of physical apertures disposed around the substantially centrally located physical aperture.

7. The microwave energy interactive insulating structure of claim 1, wherein the plurality of physical apertures is arranged in a random configuration.

8. The microwave energy interactive insulating structure of claim 1, wherein the microwave energy interactive material is operative for absorbing at least a portion of impinging microwave energy and converting it to thermal energy.

9. The microwave energy interactive insulating structure of claim 1, wherein the moisture-containing layer comprises at least one of paper and paperboard.

10. The microwave energy interactive insulating structure of claim 1, wherein the second polymer film layer comprises biaxially-oriented polyethylene terephthalate.

11. The microwave energy interactive insulating structure of claim in combination with a platform for elevating the food item, wherein the platform includes an aperture in a substantially aligned relationship with a physical aperture of the plurality of physical apertures of the microwave energy interactive insulating structure.

12. The combination of claim 11, wherein the platform includes a substantially planar portion and a plurality of downwardly extending support elements, the downwardly extending support elements defining a void beneath the substantially planar portion, and the microwave energy interactive insulating structure overlies the substantially planar portion of the platform.

13. The combination of claim 12, wherein the microwave energy interactive insulating structure overlies the substantially planar portion of the platform so that the second polymer film layer is in a facing, at least partially contacting relationship with the platform.

14. The combination of claim 13 in combination with a food item, the food item having a bottom surface that is desirably at least one of browned and crisped, wherein the food item is positioned on the first polymer film layer of the microwave energy interactive insulating structure.

15. A system for heating a food item in a microwave oven, comprising:

a microwave energy interactive insulating structure, including a susceptor film comprising a layer of microwave energy interactive material supported on a first polymer film layer, the layer of microwave energy interactive material being operative for converting at least a portion of impinging microwave energy into thermal energy, a moisture-containing layer joined to the layer of microwave energy interactive material, a second polymer film layer joined to the moisture-containing layer such that the moisture-containing layer is positioned between the microwave energy interactive material and the second polymer film layer, the second polymer film layer being partially joined to the moisture-containing layer to define a plurality of first cells between the moisture-containing layer and the second polymer film layer, the plurality of first cells comprising a plurality of second cells being adapted to inflate in response to sufficient exposure to microwave energy, the predetermined pattern comprising a plurality of lines of adhesion disposed between the moisture-containing layer and the second polymer film layer, and a plurality of physical apertures extending through the first polymer film layer, the moisture-containing layer, and the second polymer film layer, the physical apertures being arranged so that the plurality of first cells further comprises a plurality of third cells that are interspersed among the second cells, wherein for each third cell of the plurality of third cells, at least one physical aperture of the plurality of physical apertures extends at least partially through the third cell so that the at least one physical aperture inhibits any inflatability of the third cell, the plurality of third cells comprises a first one of the third cells and a second one of the third cells, the plurality of lines of adhesion comprises a first line of adhesion positioned between the first one of the third cells and the second one of the third cells, and a first physical aperture of the plurality of physical apertures is configured so that the first physical aperture extends at least partially through each of the first line of adhesion, the first one of the third cells, and the second one of the third cells; and a platform for supporting the microwave energy interactive insulating structure in an elevated position, the platform including apertures respectively substantially aligned with the physical apertures of the microwave energy interactive insulating structure, wherein the platform includes a substantially planar portion and a plurality of downwardly extending support elements, the downwardly extending support elements defining a void beneath the substantially planar portion.

16. The microwave energy interactive insulating structure of claim 1, wherein the first physical aperture has a major linear dimension of about 0.25 inches.

17. The microwave energy interactive insulating structure of claim 1, wherein:

the plurality of lines of adhesion further comprises a second line of adhesion, the second line of adhesion extends crosswise to the first line of adhesion, the plurality of third cells further comprises a third one of the third cells, the second line of adhesion is positioned between the first one of the third cells and the third one of the third cells, and the first physical aperture extends at least partially through each of the second line of adhesion and the third one of the third cells.

18. The microwave energy interactive insulating structure of claim 1, wherein each of the first one of the third cells and the second one of the third cells has a major linear dimension of from about 0.5 to about 1.5 inches.

19. The microwave energy interactive insulating structure of claim 17, wherein the microwave energy interactive material is operative for absorbing at least a portion of impinging microwave energy and converting it to thermal energy.

20. The microwave energy interactive insulating structure of claim 17, wherein the first physical aperture has a major linear dimension of about 0.5 inches.

21. The microwave energy interactive insulating structure of claim 17, wherein:

the plurality of third cells further comprises a fourth one of the third cells, the first line of adhesion is positioned between the third one of the third cells and the fourth one of the third cells, the second line of adhesion is positioned between the second one of the third cells and the fourth one of the third cells, and the first physical aperture extends at least partially through the fourth one of the third cells.

22. The microwave energy interactive insulating structure of claim 21, wherein:

the plurality of third cells further comprises a fifth one of the third cells and a sixth one of the third cells, the first line of adhesion is positioned between the fifth one of the third cells and the sixth one of the third cells, and a second physical aperture of the plurality of physical apertures is configured so that the second physical aperture extends at least partially through each of the first line of adhesion, the fifth one of the third cells, and the sixth one of the third cells.

23. The microwave energy interactive insulating structure of claim 1, wherein:

the plurality of third cells further comprises a third one of the third cells and a fourth one of the third cells, the first line of adhesion is positioned between the third one of the third cells and the fourth one of the third cells, and a second physical aperture of the plurality of physical apertures is configured so that the second physical aperture extends at least partially through each of the first line of adhesion, the third one of the third cells, and the fourth one of the third cells.

24. The system of claim 15, wherein:

the plurality of lines of adhesion further comprises a second line of adhesion, the second line of adhesion extends crosswise to the first line of adhesion, the plurality of third cells further comprises a third one of the third cells, the second line of adhesion is positioned between the first one of the third cells and the third one of the third cells, and the first physical aperture extends at least partially through each of the second line of adhesion and the third one of the third cells.

25. The system of claim 24, wherein:

the plurality of third cells further comprises a fourth one of the third cells, the first line of adhesion is positioned between the third one of the third cells and the fourth one of the third cells, the second line of adhesion is positioned between the second one of the third cells and the fourth one of the third cells, and the first physical aperture extends at least partially through the fourth one of the third cells.

* * * * *